United States Patent [19]

Marbourg

[11] Patent Number: 4,581,962

[45] Date of Patent: Apr. 15, 1986

[54] TOOL TO CAPTURE, CONTROL AND MANIPULATE THREADED FASTENERS

[76] Inventor: Edgar F. Marbourg, 437 Hillcrest Rd., San Carlos, Calif. 94070

[21] Appl. No.: 577,071

[22] PCT Filed: Jun. 3, 1983

[86] PCT No.: PCT/US83/00855

§ 371 Date: Jan. 26, 1984

§ 102(e) Date: Jan. 26, 1984

[87] PCT Pub. No.: WO83/04453

PCT Pub. Date: Dec. 22, 1983

Related U.S. Application Data

[63] Continuation-in-part of Ser. No. 385,540, Jun. 7, 1982, Pat. No. 4,455,898.

[51] Int. Cl.[4] ..... B25B 23/08

[52] U.S. Cl. ..... 81/451; 81/452; 81/453; 81/454; 81/457

[58] Field of Search ..... 81/451, 452, 453, 454, 81/455, 456, 457, 458, 90 C, 125

[56] References Cited

U.S. PATENT DOCUMENTS

| | | | |
|---|---|---|---|
| 796,154 | 8/1905 | Schulze | 81/453 |
| 2,796,100 | 6/1957 | Dierker | 81/457 |
| 2,954,809 | 10/1960 | Loewy | 81/452 |
| 4,190,091 | 2/1980 | Colognori | 81/453 |
| 4,455,898 | 6/1984 | Marbourg | 81/454 |

*Primary Examiner*—Frederick R. Schmidt
*Assistant Examiner*—J. T. Zatarga
*Attorney, Agent, or Firm*—Marshall C. Gregory

[57] ABSTRACT

The invention is intended for use with threaded fasteners, screws, bolts and similar devices, in their almost limitless applications to assembling objects and structures. These fasteners exist in many types, each requiring a special tool bit.

On many occasions screws or other fasteners must be installed or removed in locations difficult of access and of which clear view may not be obtained, also where use of two hands is not possible. This invention is particularly intended for these situations.

The invention comprises basically a combination of a barrel (11 or 811) and collar (20 or 201), preferably made of stiff but flexible plastic, which fit over and enclose a tool for threaded fasteners, either with a fixed bit or one which can accept insertable bits. The barrel (11) provides at its working or tip end a set of flexible elements (31) which act to grip screw heads and hold them registered with the tool. The barrel (11) can be fixed in place on the tool shaft by a partial turn of either form of collar (20 or 201). Collar (201) works with a spring (202) to move the barrel (11) into gripping position. A variation for jewelers' screwdrivers uses a miniature barrel (170) without a collar but with a spring (202).

15 Claims, 19 Drawing Figures

FIG. 3a
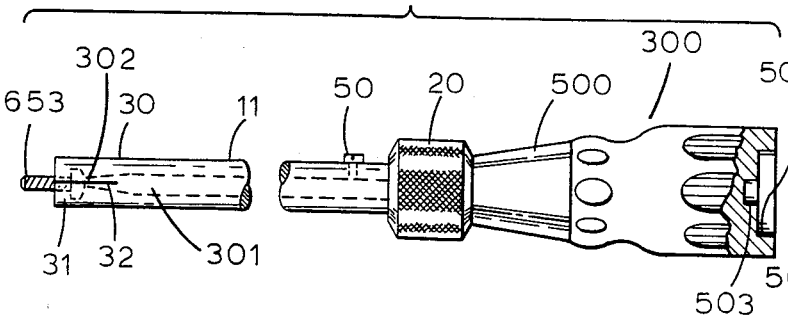
FIG. 3b
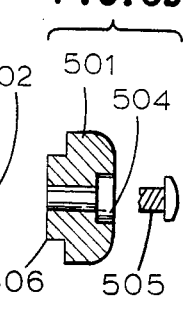
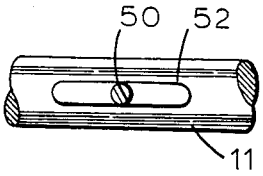
FIG. 3c
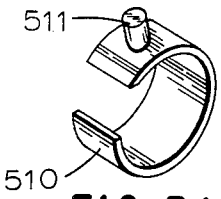
FIG. 3d
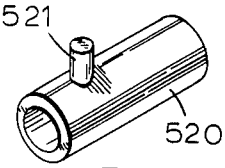
FIG. 3e
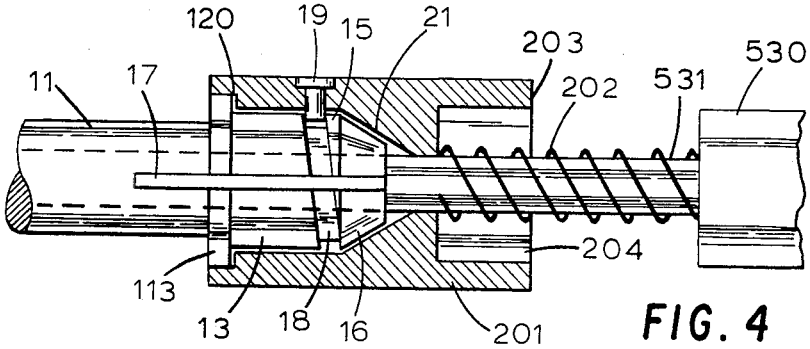
FIG. 4
FIG. 5a
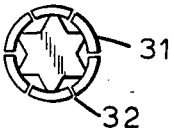
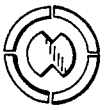
FIG. 5b
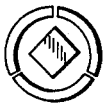
FIG. 5c

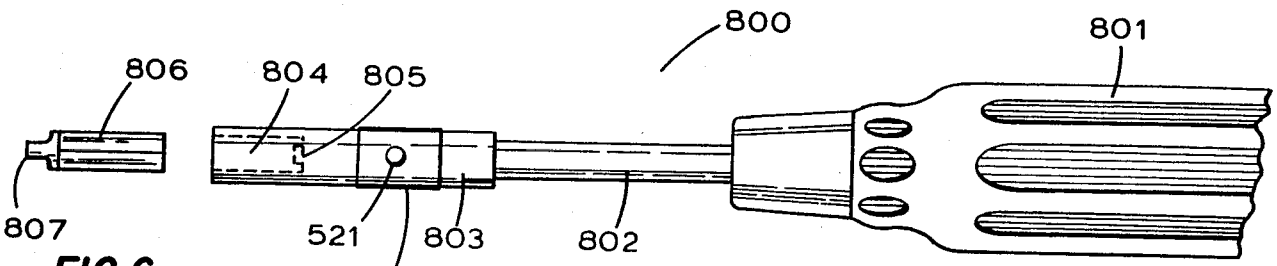
FIG. 6b
FIG. 6a
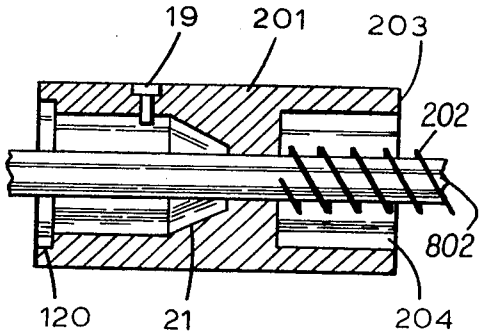
FIG. 6e
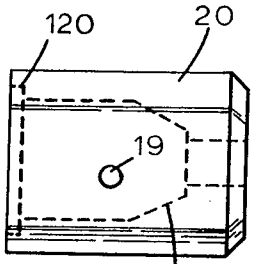
FIG. 6d
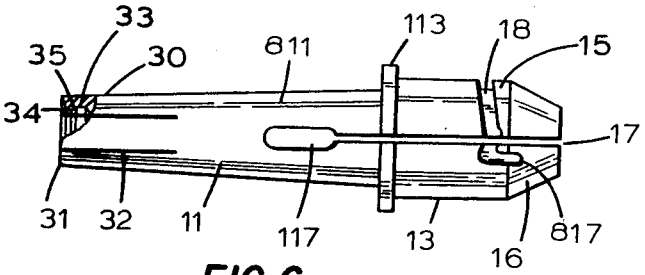
FIG. 6c

TOOL TO CAPTURE, CONTROL AND MANIPULATE THREADED FASTENERS

TECHNICAL FIELD

The field of the invention is a common and widespread type of tool, namely a screwdriver or similar tool or implement adapted to starting and driving, or in reverse order to locating and removing screws, machine bolts or screws and analagous or similar threaded fasteners in their various sizes and forms. In one of its forms it is a device for holding screws in registration with the tool bit and starting them in holes (but not driving them home); another is designed for manufacture as an integral part of a complete tool which would be capable of both operations; yet another is designed to be adapted to existing tools (both fixed-bit and with insertable bits) and one special adaptation applies to jewelers' screwdrivers, and includes an ancillary tool which facilitates replacement of very small machine screws in eyeglass frames by feel alone, as one might be required to do if a second pair of glasses is not handy.

The adapting device may be fitted to or integrally made as part of tools for all types of screws or machine bolts, including not only the common slotted (fillister) or Phillips head screws, but also special designs such as the Pozidriv, clutch, Torx, Scrulox, Allen head (hex) and Reed Prince. Depending on head design, it could also be adaptable to types of sheet metal fasteners which have only partial threads, e.g. Dzus fasteners.

In a field of art as fundamental as this one, there is broad base of existing art. The basic elements of this invention, taken separately, may resemble existing devices, however their combination as described herein produces a cooperating family of tools which efficiently performs tasks which cannot all be accomplished, nor perhaps any of them as well, with any of the available devices known to applicant, who believes himself to be one skilled in this particular art, and knowledgeable concerning such tools.

BACKGROUND ART

One of the most annoying and difficult problems in the use of screws and fasteners is that of inserting and driving them, or in reverse order locating and removing them, in recesses or places where it is difficult to see the head or socket, and where in addition it may be difficult or not possible to use two hands or an auxilliary tool. In these situations, it is necessary, to start and drive the screw, to have a tool which will hold the screw itself, yet release it when necessary. In the case of locating and removing a screw in such a location, it is further necessary to have a tool which will enable the user to locate the screw and center the bit of the tool to register with the head, then also capture it dependably and withdraw it as it is unscrewed.

Many devices have been offered in an approach to solving this problem, or these associated problems, as summarized below. Most of them require two handed operation of the tool to lock or affix it to a screw head, are difficult to apply or perhaps jam themselves under the head after driving the screw home, will not fit in narrow recesses or depressions, or do not perform all the operations required. The proposed invention is designed, simply, to do more of these things better.

A widely distributed magazine in the United States, Popular Science (Times Mirror Magazines, 380 Madison Avenue, New York City) featured in its May 1982 issue a survey and summary article on the field of screwdrivers. This article begins on page 132, and summarizes various special type screws and tools associated therewith. On page 134 there is mention of various types of screw holders or starters considered as commercially available, with specific mention of the most common forms with spring fingers or leaves which must be engaged with the head, or those with a wedge or center leaf which turns and jams in a screw slot to hold the screw on the tool bit.

A number of patents have issued on various devices intended to address these associated problems, and reference will be made to the following United States Patents known to applicant herein to have issued. They are listed with names of patentees, and with assigned letters for ease of reference.

| Ref. | U.S. Pat. No. | Patentee | Date |
|---|---|---|---|
| A | 355,392 | Fellers | 1887 |
| B | 601,188 | Webster | 1898 |
| C | 881,296 | Chappel | 1908 |
| D | 1,229,793 | Ryan | 1917 |
| E | 1,889,330 | Humes, et al (1) | 1932 |
| F | 1,925,385 | Humes, et al (2) | 1933 |
| G | 2,028,546 | John | 1936 |
| H | 2,566,673 | Nygaard | 1951 |
| I | 2,633,168 | Mahaffey | 1953 |
| J | 2,762,408 | Baldwin | 1956 |
| K | 2,952,285 | Roosli | 1960 |
| L | 2,954,809 | Loewy | 1960 |

These patents teach a variety of methods for gripping or holding screws and fasteners, and at least one (H,) provides for a set of removable bits or heads to convert it to a variable size wrench also. Reference D, to Ryan, involves a bulky box-shaped holding structure with a thumb lever for engagement which could not be used in a confined space or recess. Some of the features disclosed are the relatively common leaf-spring fingers (described in the Popular Science article) which must be positioned with care to hold a screw head (References A, B, I, J and K); a split tube type gripping device (References C, E, F, G, and L); and various methods of activating the holding means, such as cams (References G and L) and double or triple sleeves or barrels which act upon each other (References E, F, H, J and K). Some aver that the device automatically releases its grip (References E, F and I), while others require two-handed or two-step operation to lock and/or unlock (References A, B, D, J and L).

DISCLOSURE OF THE INVENTION

The invention herein is intended to offer several advantages over the devices disclosed in the references. It provides simple operation in confined spaces, not requiring two hands or a separate tool; it accurately locates a screw which is to be removed, aligning the bit or blade with the head, captures the screw head easily, and maintains the bit in register with the screw head whether removing it or driving it home. It also is easy to disengage from the head of a screw which has been driven home—the spring leaf types in particular may be captured under the screw head and locked in or jammed if not disengaged earlier, an operation which may be extremely difficult in a confined space. These advantages are available in the references, if at all, to only a limited degree.

The invention comprises a multiple adaptation of a basic barrel or sleeve-type mechanism which at one end is configured to provide a gripping and holding device for screw heads while at the other end it is provided with a simply operated clutch which allows it to be quickly locked in place on a bit or shaft of a screwdriver which it encloses. In cooperation with this basic barrel mechanism, a collar acts to lock the clutch referred to above, and hold the barrel device in place with reference to its cooperating bit of whatever type.

The five primary variations are briefly mentioned here, with reference for simplicity to the figure best showing each, however the description of the drawings and detailed description of the best embodiments will follow in their place.

In the simplest and first variant, for use as a screwstarter, the basic barrel encloses a plastic bit of the same material (although it may be provided with a hardened tip to better withstand wear) which is quickly insertable, and easily interchangeable with another providing a different tip to match different types of fasteners. This adaptation is shown in FIG. 1.

Second is the principal adaptation to standard tools for driving and or removing threaded fasteners. Shown in FIG. 3 is the basic barrel/collar combination (shown in detail in FIG. 2) as mated to a standard fixed-bit screwdriver, with details of guide-pin arrangements. In addition, there is a widely available type of tool for threaded fasteners marketed by several companies which provides a standardized barrel with a hexagonal socket adapted to accept and retain by magnetic attraction a standardized series of small bits providing different types and sizes of bits for available fasteners. These interchangeable bits are also made and sold by different manufacturers, but are of the same size and within a small range, are of the same length. FIG. 8 shows the basic barrel and collar combination as adapted to one of these magnetic screwdrivers.

The third variant is an alternate adaptation of the basic collar (See FIG. 4), which provides for an annular recess in the end thereof nearest the handle of the cooperating tool, so that a spring placed over the tool shaft and between the collar and the handle will exert force to extend the collar and barrel towards the bit end of the tool. The skirt of the collar in this adaptation may be sufficiently lengthened as to go over the ferrule of the handle and provide for electrical protection if the ferrule be metal. This design with spring extension is particularly adapted to the task of locating screws which are to be withdrawn from places difficult of access or visual perception. With the grip means of the barrel extended beyond the tool tip by the spring pressure, the screw head can be located by feel, the bit centered upon it, then as the screw is initially withdrawn the grip means can be locked upon the head thereof to secure its retrieval. This varient is adaptable to any of the forms of the tool discussed, except the initial variant, which is strictly intended as a screwstarter.

In these basic variations, the concept of the invention is to provide a family or set of sizes to fit the entire range of sizes of screws and other fasteners, and adapt to the corresponding range of driving tools with different tips, and configuration of blades. Further variations are contemplated to make the device more flexible. Among these may be the provision in the barrel of two grooves to allow it to be used over the wide tip of the keystone blade configuration.

The heart of the invention, and common to all its variations albeit modified by the elimination of the collar in the jewelers' screwdriver mode, and modified to provide the split barrel mode is the barrel and collar assembly, shown.

Fundamental to the design and improvement offered by the invention is the use of a material of proper characteristics combining not only the toughness to withstand the use contemplated, but also the resiliency to repetitively produce the spring action necessary to accept and grip the screw heads. While the device would work well if fabricated from certain metals, such as brass, production costs would be extremely high, and the concept of the invention is to produce inexpensive sets of a cooperating family of tools. It is therefore preferred to make it from a plastic of the requisite toughness, flexibility and elasticity, which is capable of being injection molded and finish-machined (if required) inexpensively and by automated processes. A material meeting these requirements is marketed by DuPont Company under the name Delrin. It is a polyoxymethylene, and may be considered in the classes of a polyacetal of polyformaldehyde. The basic Delrin might well be satisfactory, but it is preferred to use a variety which has been "rubber-toughened" by a proprietary process, and is designated Delrin 500T (for "tough"). There is also a Delrin 100ST (for "super tough") which could be used. Characteristic of the toughened types of Delrin is that the failure mode is changed from a brittle fracture mode in the basic Delrin to a ductile failure mode (rough tearing) in the 100ST and 500T varieties. There are other materials which could be used and the invention is of course not limited solely to the use of the preferred material.

To produce the parts of the invention by injection molding, it is necessary to provide a taper of at least 1° in that smaller section of the barrel which contains the grip means (up to the flange seen in the figures). The larger or head section, however, remains cylindrical for engagement with the collar. This taper gives increased rigidity to the flexible screw-gripping members, so that more segments are required.

BRIEF DESCRIPTION OF THE DRAWINGS

FIG. 1 Shows the screwstarter mode of the invention.

FIG. 2 Shows the basic barrel and collar of the invention.

FIG. 3 Shows the basic barrel and collar as adapted to a screwdriver.

FIG. 3*a* Is the overall tool, excepting a swivel cap;

FIG. 3*b* Shows the handle's swivelling cap;

FIG. 3*c* Shows a detail of the barrel control pin/slot;

FIG. 3*d* Shows a partial ring and pin for shaft mounting;

FIG. 3*e* Shows a full tube and pin for shaft mounting.

FIG. 4 Shows a modification of the basic collar as adapted for a spring pressure extension mode.

FIG. 5 Shows an end view of the screw gripping means with illustrative special bits.

FIG. 5*a* Shows a Torx bit, with six grip segments;

FIG. 5*b* Shows a clutch bit with four grip segments;

FIG. 5*c* Shows a Scrulox bit with three grip segments.

FIG. 6 Shows the invention as used with a commercially available magnetic screwdriver.

FIG. 6*a* shows one of the insertable bits which adapt the magnetic tool to different fasteners;

FIG. 6*b* is the configuration of the commercial tool;

FIG. 6*c* shows the barrel of this invention as used with the magnetic tool;

FIG. 6*d* is the basic collar of this invention;

FIG. 6*e* is the alternate collar adapted for spring pressure extension of the collar/barrel."

MODES FOR CARRYING OUT THE INVENTION

The variants of the invention summarized above are described in detail, each offering its own advantages. The best or most flexible mode is shown in FIG. 6 (which combines the alternatives of FIGS. 3 and 4).

Figure 1B:
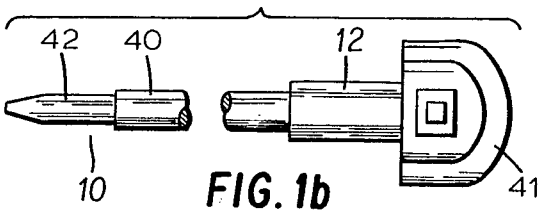
FIG. 1*b* Shows the insert used as a screwstarter.
Figure 1A:
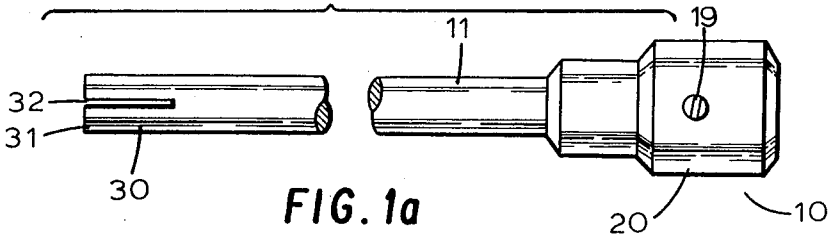
FIG. 1*a* Displays the barrel or sleeve basic to the various modes described hereafter.

First, that adaptation which is intended for use as a screwstarter only, referring first to FIG. 1, where it is shown with its two parts separated; FIG. 1*a* showing the barrel or sleeve, FIG. 1*b* the insert. Barrel or sleeve 11 (FIG. 1*a*) is shown in greater detail in FIG. 2. At one end of barrel 11, here the left, is the screw-gripping means 30, with grooves inside its end specifically designed for holding screw heads (these grooves are shown in detail in FIG. 2*c*). At the other end is an enlarged section 13 which ends in face 16. (that of a truncated cone), said end face being split by slots 17 into a plurality of segments 15. Collar 20 is adapted, as later described, to be tightened over section 13 and segments 15, squeezing the latter segments 15 tight upon the insert shaft 40 and acting as a clutch to hold the barrel 11 in fixed position with respect to insert 12.

As shown, insert 12 comprising shaft 40 and bit 42, provides the working tool, and is a bit which may be quickly interchanged for another. It is made of the same plastic described before, although it may have a hardended tip.

Figure 2B:
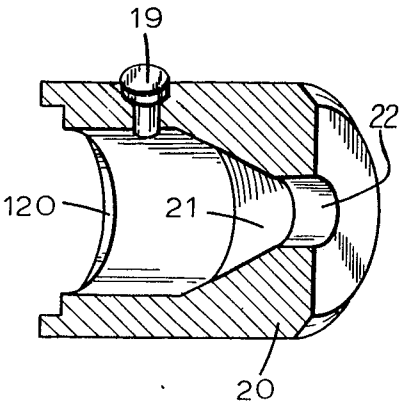
FIG. 2*b* Shows the collar for barrel positioning.
Figure 2A:
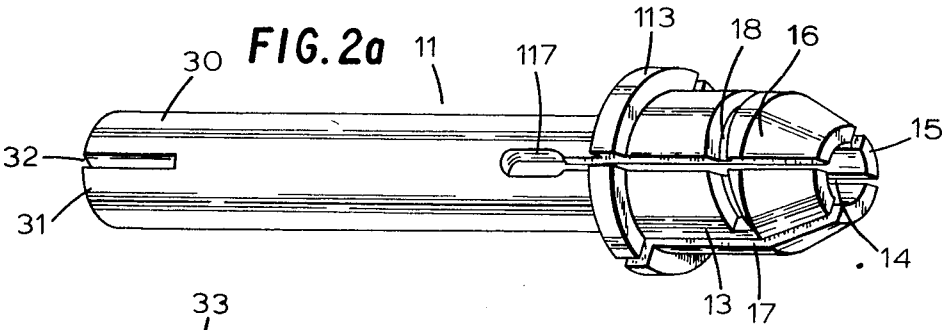
FIG. 2*a* Is the basic barrel or sleeve.
Figure 2C:
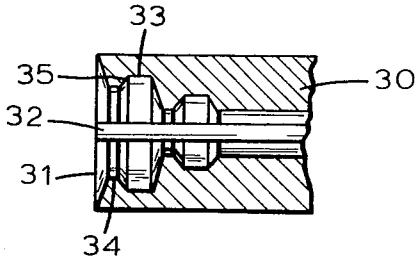
FIG. 2*c* Is a detail of the grip means construction.

Details of the screw-gripping means 11 appear in FIG. 2*c*. The tube of barrel 11 is slit longitudinally into a plurality of segments 31 by slots 32, which extend far enough into barrel 11 so that segments 31 act as flexible members which accept and retain screw heads, yet elastically return. Depending upon the mode of manufacture and use, from three to six segments 31 are satisfactory. (FIG. 5 shows three special bit, with grip-means of three, four and six segments. If the barrel is machined to be truly cylindrical, then three or four segments are effective. However, the one degree taper required for injection molding stiffens the segments so that six are required to make them flexible enough, and also for the split-barrel mode (FIG. 6) six may be required. Grip means 30 hold screw heads by a combination of the spring action of segments 31, but also by annular grooves 33 which are holding grooves especially adapted and formed interiorly in the end of means 30. Annular grooves 33 are provided in two different sizes to accept different sizes of screw heads, being separated by shoulders 34. The angle of faces 35 to the longitudinal axis of barrel 11 is approximately 75°, although a range of angles about this number would function satisfactorily. This angle not only provides for a cam action to flex the segments or fingers 31 and allow entry of a screw head, and then facilitates its holding, but also acts to allow release of a screw head, as in the case where it is driven home by the screwdriver mode. Two head-holding grooves 33 are shown here, each being capable of engaging more than one screw size, so that the tool may handle a range of heads. While three or even more sizes of holding grooves 33 could be provided, and may be, it is unrealistic to expect the smaller heads to be associated with the longer screws, so that two grooves are shown, as the nominal design intention.

At the other end of barrel 11, as shown in FIG. 2*a*, is a section of enlarged diameter 13, which forms a head to cooperate with collar 20 in providing a clutch action for holding the barrel 11 fixed with relation to the shaft of the enclosed bit (here in the screwstarter version 40). Head 13 terminates in a convex conical surface 16, truncated, and slit by slots 17 into a plurality of segments 15. There are in the clutch assembly as shown four segments 15, but in the split tube mode described later there may be six. The angle of conical face 16 to the longitudinal axis of barrel 11 is 30°, although a range of angles greater or less than this, within a reasonable range, would be usable. Collar 20, which accepts the head 13 of barrel 11, has within it a concave conical surface 21, acting as a female coupling device with face 16 to as a clutch and hold barrel 11 fixed with relation to the contained shaft. As explained below, rotation of collar 20 forces conical face 21 against face 16, compressing segment 15 as a clutch.

Referring again to FIG. 2, pin 19, also of Delrin, is fixedly installed in collar 20 by spin welding, ultrasonic welding, or pressing in place. The purpose of pin 19 is to engage thread slot 18, which is formed in the surface of the cylindrical portion of head section 13 as a groove or depression with the pitch of a number eight thread, by which is meant eight turns to the inch (2.54 cm), so that rotation of collar 20, once pin 19 is engaged in thread slot 18, acts to draw head section 13 into collar 20, which forces conical surface 16 against coupling conical surface 21 in collar 20. This action compresses segments 15 against the enclosed tool shaft (301 in FIG. 3), acting as a friction clutch to hold the collar/barrel combination (20 and 11) fixed with relation to the tool shaft. Approximately one quarter of a full turn of collar 20 is sufficient to produce this locking action. In FIG. 2*a*, showing details of head section 13, thread slot 18 is shown as a partial helix traversing almost the entire visible semi-circumference of section 13, beginning at the juncture of the cylindrical and conical faces of section 13, and progressing away from conical face 16. In that segment 15 nearest to but not containing the end of thread slot 18 closest to conical face 16 a longitudinal slot (shown in FIG. 8 as 817) is provided for entry of pin 19 to a point abreast of that beginning end of thread slot 18, to allow assembly of barrel 11 and collar 20 on a tool shaft. (A small shoulder is provided at the end of slot 18 to retain pin 19 therein once engaged.)

In FIG. 2 are shown the center holes for the tool shaft (14 and 22). A base ring or flange 113 on head section 13 acts to provide a firm base against which collar may abut when turned to clamp, and flange 113 is accepted and fits within recess or annulus 120 in collar 20.

In the case of the screwstarter version, it is intended that the head 41 of insert 12 may be color or touch coded to indicate the type of bit—a feature which of course could be also used in the other modes of the invention.

The widened slot indicated as 117, with an enlarged end, will be described in connection with a subsequent mode.

It should be understood that the two basic features of the invention just described, that is the manner of gripping and holding a screw head in means 30 (as shown in phantom in FIG. 3*a*), and the clamping action of collar 20 and head section 13 on a cooperating tool shaft by a quarter turn of collar 20 are essentially unchanged. The grip means 30 will engage a screw head either by being forced over it, or by having the head inserted in it manually.

The best embodiment of the invention, as adapted to standard tools, is shown in FIGS. 3 (plus collar in FIG. 4) and 6.

FIGS. 3*a* and 3*b* show the overall tool 300, comprising handle 500, with swivelling end cap 501, and showing in phantom shaft 301 with its terminal bit 302 inserted through and contained within barrel 11, which is the same piece as already described and as shown in FIG. 2. Head gripping means 30 with its slots 32 dividing it into segments 31 has also been described hereinabove. Collar 20, as shown in FIG. 3*a* is the same as that already shown and described. Rotating cap 501, (FIG. 3*b*) is a desirable feature of the tool made for this invention. Circular boss 506 fits into annulus or socket 502 in the end of handle 500, and retaining screw 505 passes through hole 504 into a threaded receiving fitting 503. The handle cap will then rotate or spin freely so a hand may press thereon while rotating the tool.

A machine screw, here donated 653, is shown held in gripping means 30, and engaged with tool bit 302, with its head in phantom. Although not detailed in this figure, the holding grooves 33 and shoulder 34 previously described and shown in FIG. 2 are an integral feature of means 30. In operation, the screw is inserted in means 30, and engaged with the tool bit, collar 20 is turned to hold barrel 11 firmly placed with respect to shaft 301, and screw 653 may be started and driven home, at which time the described cam action in grip means 30 will release the head for withdrawal of the tool.

The movement of barrel 11 along a tool shaft may be contained within its operating range by a control pin, here shown as 50 protruding through slot 52 in barrel 11 (FIG. 3*c*). While this pin is not necessary, it is a desirable feature for best operation, and may be attached in several ways. A small screw 50 may be set in a threaded socket in shaft 301; a clip ring 510 of spring steel (or equivalent) with pin 511 affixed thereto may be snapped or pressed on a tool shaft; or a tube 520 with pin 521, preferably molded of Delrin may be cemented to the tool shaft with one of several available "super glues". Tube 520 is best adapted to cylindrical shafts, clip ring 510 to other forms.

Barrel 11 is shown in simplified form in FIG. 3, however it is the same barrel as detailed in FIG. 2. It may frequently be the case that there will not be a threaded socket for a pin 50, and if the optional guide pin is to be used, barrel 11 and collar 20 may desirably be assembled over a tool shaft to which a barrel control pin has been affixed by use of a clip ring 510 or tube 520, as above. For this purpose, it is intended that one of the slots 17 in barrel 11 be made slightly wider than the others, to allow barrel 11 to be forced past guide pin 511 or 521 by passing said guide pin through this widened slot 117, shown in FIGS. 2, 7 and 8. Barrel 11 will deform to allow passage of the pin through the slot. Slot 117 also extends farther into barrel 11 and terminates in a broader section which will then function as as a barrel movement control slot as in 52 above.

The tool as shown in FIG. 3 is the basic tool design for holding fasteners for starting, driving and assembly purposes. A more versatile tool is produced by replacing collar 20 by collar 201 which is adapted to cooperate with a spring 202 to force the collar and barrel assembly towards the tip or working end of the tool, which so acts as to extend the grip means 30 beyond the tool tip (302) and thus serve as a screw locating device, capable of finding screws in recesses or hidden sockets, centering the tool thereon, and gripping them as they are retracted, for retrieval.

Referring to FIG. 4, this variation of collar 20 is shown as 201. It is shown engaged with a head section 13 of barrel 11, and pin 19 is shown engaged with partial thread slot 18, precisely as described above. As shown here, head section 13 has not been drawn fully into collar 20, so head segments 15 are not compressed on shaft 531, as they would be if collar 201 were fully tightened. Space is seen between surfaces 16 and 21, and also in annulus 120, enclosing flange 113. Collar 201 is provided with a skirt or ring 203 enclosing an annular recess 204 radially disposed with respect to the associated tool shaft (indicated as 531) inserted through collar 201 and engaging with barrel 11. Spring 202 is emplaced around the tool shaft 531, abutting against handle 530 and the socket or recess 204 in collar 201 so that the spring pressure acts to force collar 201 (and barrel 11) away from the handle and towards the tip end of the associated tool.

This adaptation of the basic collar 20 to the use of an extension spring 202 is applicable to other modes of the invention and serves to increase the versatility of the family of tools comprising this invention, making it possible to locate, center on and grip screw or bolt heads by touch or feel when visibility if their position is impaired.

Referring to FIG. 6, there is shown the use of this invention with a widely available commercial tool sold by several companies (Klein, Mac, and others) under names indicating that there is a magnetic feature. (The Klein tool is called a "magnetic screwdriver"). The operation of this tool, here 800, is indicated in FIG. 6*b*: a tool handle 801, a shaft 802 are the same as any screwdriver; on shaft 802 is affixed an enlarged section 803, which acts as a receiver for insertable bits, one of which is shown as 806. These bits, of standard hexagonal cross-section and length, are provided by several manufactures with a variety of types and sizes of working tips 807. These bits 806, one being shown in FIG. 6*a*, fit into socket 804, shown in phantom in receiver 803, being held in the socket by magnet 805, also in phantom.

FIGS. 6*c* and 6*d* show a basic barrel 11 and collar 20 in relation to tool 800 as they would be assembled with it, to operate on the receiver 803 and be able to encompass the end of bit 806. The barrel in this figure is denoted as 811, and is shown with the taper of approximately 1°, here slightly exaggerated, necessary for injection molding. As previously stated, this tapered sidewall requires the use of six segments 31 in grip means 30, as so shown here. Also detailed here again are slots 31, holding grooves 33, shoulders 34, and separating cam surfaces 35, all of which function precisely as previously described. The control pin if such is desired, is here shown as 521, as it is preferred to affix a control pin, if required, to receiver 803 by cementing a tube 520 with pin 521 thereto and to provide barrel 811 with a widened slot 117 ending in a broadened portion as a pin retaining section, as also previously described, to allow sliding barrel 811 over control pin 521 affixed to the receiver 803. The collar 20 as shown in FIG. 6*d* is as previously described, and that denoted as 201 in FIG. 6*e* is also as previously described in connection with FIG. 4, and the various component parts, conical faces 16 and 21, segments 15 and slots 17, flange 113 and annulus 120, thread slot 18, skirt 203, annulus 204 and spring 202 all act as previously described.

Shown in FIG. 6*c* as 817 is the access slot previously mentioned to allow assembly of collar 19 over barrel 11 (or 811). Pin 19 on collar 20 is here shown aligned with access slot 817, so that collar 20 may be slid over head section 13, with pin 19 entering slot 817, then by turning collar 20, pin 19 is forced past a small shoulder to enter thread slot 18, to function as previously shown.

In adapting the invention to this standard tool, it may be desirable to affix a retaining skirt on handle 801 to receive the other end of spring 202. This skirt, not shown here, would be similar to that shown as 203 on collar 201. A further adapatation of this concept which could be desirable would be to extend skirt 203 on collar 201, sufficiently far (and make it larger if necessary) so that it covers and encloses the ferrule end of the associated tool handle (e.g. 500) to act to prevent arcing or shock should the tool be used to probe in areas where it might make electrical contact, (assuming a metal ferrule).

It has been found that one effect of the varying thickness of segments 31 which results from the requirement to taper barrel 811 for injection molding is that there then are six segments 31 required, and they are of sufficient flexibility and strength that they will act efficiently to grip hex nuts over a reasonable range of sizes. The barrel 811 and collar 20 and 201 combination, with an ancillary handle to operate it, could then be used in conjunction with a nut driver to provide starting of hex nuts, or their retrieval once broken loose. This would be especially helpful in recessed applications.

FIG. 5 shows an end view of grip means 30 disposed around three of the various special fastener bits to which the use of this tool may be adapted. Segments 31 and slots or slits 32 are indicated in FIG. 5*a*, but are shown in all three figures. FIG. 5*a* shows a bit for a Torx screw in conjunction with a grip means 30 disposing six grip segments 31, which might be considered to be typical of an end view of the configuration shown in FIG. 8, as Klein magnetic screwdrivers are widely available with a kit of insertable bits for Torx screws. FIG. 5*b* shows a bit for a clutch fastener and a grip means 30 with four segments 31, while FIG. 5*c* is a bit for a Scrulox or Robertson fastener with three grip segments 31. The use of three or four grip segments as in FIGS. 5*b* and 5*c* would be desirable if barrel 11 is machined to have cylindrical walls, but would not be practicable with tapered barrel 811, as explained above.

Several modes have been described for carrying out my invention, but it should be evident that it is usable with the whole range of threaded fasteners, not just standard screws, and also that further variations are possible, to include the use of different materials, such as metals of proper qualities. These further variations are considered to be within the scope of the invention disclosed.

INDUSTRIAL APPLICABILITY

The tool adaptation as described herein, which allows not only holding screws for starting and driving, but locating them for removal from places difficult of access, and its applicability to a wide variety of fasteners, has very broad potential uses, as threaded fasteners are almost universally used, and a tool to make their use more efficient is a device of great potential.

Among specific advantageous applications are:

1. Such a tool—or family of tools—could have wide applications in robotics or automated processes. With the grip means of suitable characteristics and extended to seek screw heads for example, repetitive driving of machine screws from a supply rack into workpieces could be automated, as could the use of the locating and removing capability for disassembly and repair.

2. The grip allows finding a hidden screw by touch, without visually locating it—it could even permit limited assembly/disassembly operations by persons with seriously impaired vision.

3. It acts as a positive device for ensuring engagement of a screw head with a tool bit without necessity for visual centering.

4. Constructed of plastic, it can be designed to act effectively as an insulator and shield for the tool shaft against electrical shock affecting the user.

5. It may act as a safety shield for a tool tip, preventing scratching or marring of surfaces.

6. It is a positive device for holding and starting threaded fasteners, but one which will easily release its grip.

7. It may be adapted to not only existing screwdrivers and similar tools with fixed bits, but to those which provide a socket driver for insertable bits of various types.

8. It may also be adaptable to nut drivers, for holding and/or retrieving hexagonal nuts.

9. It makes possible one-handed operation in many of these steps, instead of requiring two hands as many other tools do.

10. It is especially adapted to effecting holding of screws or other fasteners in restricted spaces.

11. For special applications, the invention could be made from metal or other material specially meeting the requirements, and machined to close tolerances (for use, for example in automated or robotics applications).

All of the foregoing uses have wide application, as threaded fasteners are almost universal in their use in modern life.

I claim as my invention:

1. A barrel of stiff but resiliently deformable material, for use with an associated tool for threaded fasteners, the shaft of said tool being inserted through said barrel so that the tip of said tool is closely associated with one end of said barrel, said barrel being further adapted at its other end to cooperate with a collar which acts when turned upon said barrel to hold said barrel fixed with relation to said tool shaft inserted therein, further providing that at each end said barrel is slit longitudinally into a plurality of segments symmetrically and circularly disposed about the said inserted tool shaft, still further providing that at the end of said barrel which associates with the tip of said inserted tool, said barrel segments are relatively thin and flexible and act as resilient members comprising gripping means for heads of threaded fasteners in association with annular grooves and shoulders on the interior surfaces of said segments which positively grip the head of a fastener accepted by said segments which expand outward to accept said fastener head, then contract upon it;

that at its other end the said barrel is formed into a head section of increased diameter, with a cylindrical portion and an end portion which presents a conical surface formed as a truncated cone, convex to said barrel, and symmetrically disposed around said cooperating tool shaft, and providing that the segments into which said head section is slit are relatively short and thick;

that in the surface of said barrel section of increased diameter is formed a single thread slot in the form of a groove which is a portion of a helix traversing substantially half the circumference of the cylindrical portion of said head section, beginning at that edge of said cylindrical portion where it meets said conical surface, and progressing into said cylindrical portion with sufficient pitch to provide for tightening said collar upon said head section.

that a collar is provided which cooperates with and accepts within it the said head section of said barrel, said collar interiorly disposing a concave conical face which mates with the conical portion of said head section, also disposing fixedly attached to said collar a pin which projects interiorly therein, which pin engages the said thread slot in the said barrel head section, so that when said collar is turned, said collar pin by the action of said thread slot draws said collar upon said barrel head section, and the conical surface in said collar compresses the segments of the conical end of said head section to grip the shaft within the barrel and hold said barrel fixed with relation to said shaft.

2. A screw starter comprising a barrel and collar as described in claim 1, with a bit of similar material, provided with a head for gripping, said bit being inserted through said barrel and collar to cooperate therewith.

3. A screw starter as described in claim 2, wherein said insertable bit is provided with a hardened tip to resist wear.

4. A screw starter as in claim 2 or 3 wherein a set of bits is provided for use with different sizes or types of screw heads.

5. A barrel and collar as described in claim 1, in association with a cooperating tool, further providing:

that the said collar described therein further dispose at the end nearest the handle of said cooperating tool an annular recess which accepts a spring placed around the shaft of said tool and bearing upon said tool handle and said collar, to extend said collar and barrel towards the tip end of said tool.

6. A barrel and collar combination as described in claim 1 or claim 5, further providing that a guide pin is fixedly attached to the shaft of said cooperating tool, said guide pin extending into or through a longitudinal slot in said barrel, so disposed as to limit and guide the movement of said barrel relative to said tool shaft.

7. A combination as described in claim 6, further providing that the guide pin may be rigidly but removably attached to said shaft of said cooperating tool.

8. A combination as described in claim 6 in which said guide pin is attached to said shaft of said cooperating tool by cementing to said shaft a tube of the stiff but deformable plastic of which the said barrel is formed, or its equivalent, providing that said projecting guide pin be integral with or fixedly attached to said tube.

9. A barrel and collar combination, in association with a cooperating tool having a guide pin affixed to the shaft thereof, as in claim 6, further providing that one of the slots which slit the said head section of said barrel into segments, be widened so that its width is slightly less than the diameter of said guide pin, said slot further extending substantially beyond said head section into the other portion of the barrel where said slot terminates in a broader portion of width slightly greater than the diameter of said guide pin, so that the barrel may be passed over said guide pin by deformation at the widened slot, whereupon the broader portion of said slot accepts and contains said guide pin to limit and guide the movement of said barrel relative to said cooperating tool shaft.

10. A combination wherein a standard tool for threaded fasteners is inserted through the barrel as described in claim 6 and used in cooperation therewith for the control and use of threaded fasteners.

11. A combination as in claim 10 wherein the standard tool used is a magnetic driver which accepts bits of varying sizes and types.

12. In association with the handle of a tool cooperating with a barrel and collar combination as in claim 1 or 5 or 10 or 11, a rotating end cap on said handle, firmly but rotatably mounted on a center mounting pivot shaft, so that said end cap may freely rotate with respect to said tool handle, while bearing firmly upon it.

13. A barrel and collar combination as in claim 1, used in conjunction with a nut driver to locate and grip hexagonal nuts for starting, or for retrieving said nuts.

14. A combination as in claim 13, with a cooperating tool shaft inserted therein to provide a handle for control of its use.

15. A combination as in claim 5, with a cooperating tool shaft inserted therein to provide a handle for control of its use, as used in conjunction with a nut driver to locate and grip hexagonal nuts for starting or retrieving said nuts.

* * * * *